US010847062B2

(12) United States Patent
Bottini et al.

(10) Patent No.: US 10,847,062 B2
(45) Date of Patent: Nov. 24, 2020

(54) TAG FOR BUNDLES OF METAL PRODUCTS OBTAINED FROM RESPECTIVE IRON AND STEEL PROCESSES

(71) Applicant: BM GROUP HOLDING S.p.A., Borgo Chiese (IT)

(72) Inventors: Mirko Bottini, Borgo Chiese (IT); Andrea Tonini, Storo (IT)

(73) Assignee: BM GROUP HOLDING S.p.A., Borgo Chiese (IT)

( * ) Notice: Subject to any disclaimer, the term of this patent is extended or adjusted under 35 U.S.C. 154(b) by 0 days.

(21) Appl. No.: 16/164,426

(22) Filed: Oct. 18, 2018

(65) Prior Publication Data

US 2020/0126455 A1 Apr. 23, 2020

(51) Int. Cl.

| | |
|---|---|
| ***G09F 3/08*** | (2006.01) |
| ***G09F 3/02*** | (2006.01) |
| ***G09F 3/00*** | (2006.01) |

(52) U.S. Cl.

CPC ..... *G09F 3/08* (2013.01); *G09F 3/02* (2013.01); *G09F 3/0297* (2013.01)

(58) Field of Classification Search

CPC . G09F 3/08; G09F 3/12; G09F 3/0297; A01K 11/0011

USPC ..... 40/301, 668, 673

See application file for complete search history.

(56) References Cited

U.S. PATENT DOCUMENTS 2,940,199 A * 6/1960 Goldberg ..... A01K 11/001 40/301
4,826,381 A 5/1989 Kiriyama
4,885,855 A * 12/1989 Marks, Sr. ..... A01K 11/001 40/301
5,714,234 A 2/1998 Robertson
6,055,752 A * 5/2000 Ritchey ..... A01K 11/002 40/301

(Continued)

FOREIGN PATENT DOCUMENTS

| | | |
|---|---|---|
| CA | 2449100 A1 | 5/2005 |
| EP | 2933200 A1 | 10/2015 |

(Continued)

OTHER PUBLICATIONS

Search Report dated Mar. 21, 2018 from corresponding Italian Application No. IT 201700060631.

(Continued)

*Primary Examiner* — Joanne Silbermann

(74) *Attorney, Agent, or Firm* — Innovation Capital Law Group, LLP; Vic Lin

(57) ABSTRACT

A tag for bundles of metal products comprising: a plate-like structure made of a metal material and having at least one reading surface to support an identification code; a junction element that can be engaged to the plate-like structure so that they can be moved and rotated integrally, the junction element having a gripping portion projecting from the reading surface of the plate-like structure and gripped by a gripping head of a robot or an automated mechanical arm, the junction element also having a fixing portion, opposite the gripping portion, protruding from a surface of the plate-like structure opposite the reading surface, the fixing portion of the junction element being fixable to a respective bundle of metal products, preferably by a welding operation, in particular an electric-arc welding operation.

12 Claims, 4 Drawing Sheets

(56) References Cited

U.S. PATENT DOCUMENTS

| | | | | |
|---|---|---|---|---|
| 7,690,141 | B2 * | 4/2010 | Steinfort | A01K 11/004 119/655 |
| 8,701,317 | B2 * | 4/2014 | Le Devehat | A01K 11/001 40/302 |
| 2010/0031711 | A1 * | 2/2010 | McKeown | E05B 73/0017 70/57.1 |
| 2011/0088295 | A1 * | 4/2011 | Ibsen | A01K 11/001 40/301 |
| 2015/0235576 | A1 * | 8/2015 | Goodwin | A01K 11/001 40/360 |

FOREIGN PATENT DOCUMENTS

| | | | |
|---|---|---|---|
| EP | 3410423 | A1 | 12/2018 |
| IT | 1423233 | | 9/2014 |
| JP | H09150818 | A | 6/1997 |

OTHER PUBLICATIONS

Italian Search Report from corresponding Italian Application No. 201800021364.

* cited by examiner

TAG FOR BUNDLES OF METAL PRODUCTS OBTAINED FROM RESPECTIVE IRON AND STEEL PROCESSES

BACKGROUND OF THE INVENTION

The present invention relates to a tag for bundles of metal products obtained from respective iron and steel processes. The object of the present invention finds particular employment in all processes for tracking metal products obtained from one or more iron and steel processes.

As is well known from the Italian patent number 1423233, the tracking of bundles of metal products obtained from one or more respective iron and steel processes is carried out by applying respective tags from which it is possible to read one or more piece of information and/or data relating to the product in question.

In detail, each of the tags provided comprises a metal plate-like structure that has a reading surface which bears one or more visual and/or graphic codes, readable by using corresponding electronic reading equipment.

Each tag is also provided with at least one through hole having a circular and regular profile. The through hole is configured to receive in engagement a respective nail that is welded, on one side, on at least one of the metal products that comprise the respective bundle of products to be tracked. At the opposite side, the nail has a wider head than the through hole so that the tag cannot slip out of the hole and thus remains engaged to the respective bundle of metal products.

Alternatively to the hole described above, the following are also known:

- wire-like elements, each having a first end weldable to one of the metal products to be tracked and a second looped end that engages the through-opening of the respective tag;
- clips, each engaging the through-opening of the respective tag and able to be fitted on at least one of the products to be tracked or on a respective support element associated therewith.

Although the technique used to apply the tags to the metal products obtained from respective iron and steel processes allows for a satisfactory identification of the iron and steel metal products, the Applicant has noted that it is not, however, free of some drawbacks and it can be improved in different aspects, mainly in relation to the practicality and the speed of the tag affixing operations, as well as to the simplicity in the execution of the manipulation and welding operations thereof by means of robots and/or automated mechanical arms.

In detail, the Applicant has observed that use of the support elements described above such as nails, wire-like elements and/or clips, requires a double manipulation operation.

In particular, both the tag and the support element must be manipulated simultaneously, manually or automatically by means of a robot, to couple them and apply them, by welding or other fastening systems, on the respective product to be tracked.

Consequently, the operations of manipulation and application of the tags are complicated and particularly long.

SUMMARY OF THE INVENTION

The main purpose of the present invention is to propose a tag for bundles of metal products obtained from respective iron and steel processes, able to solve the problems observed in the prior art.

A purpose of the present invention is to simplify and facilitate the operations of manipulation of the tags and of the respective support elements thereof.

An additional purpose of the present invention is to simplify, facilitate and speed up the operations of fastening the tags to the respective metal products to be tracked.

A purpose of the present invention is also to facilitate the handling of the tags to be welded by robots and/or automated mechanical arms.

The purposes specified above and others besides are substantially achieved by a tag for bundles of metal products obtained from respective iron and steel processes, as expressed and described in the following claims.

By way of example, provided below is the description of a preferred, but not exclusive, embodiment of a label for bundles of metal products obtained from respective iron and steel processes, according to the present invention.

BRIEF DESCRIPTION OF THE DRAWINGS

The description will be made herein below with reference to the accompanying drawings, provided solely for indicative purposes only and therefore non-limiting, wherein.

DETAILED DESCRIPTION OF THE PREFERRED EMBODIMENTS

Figure 1:
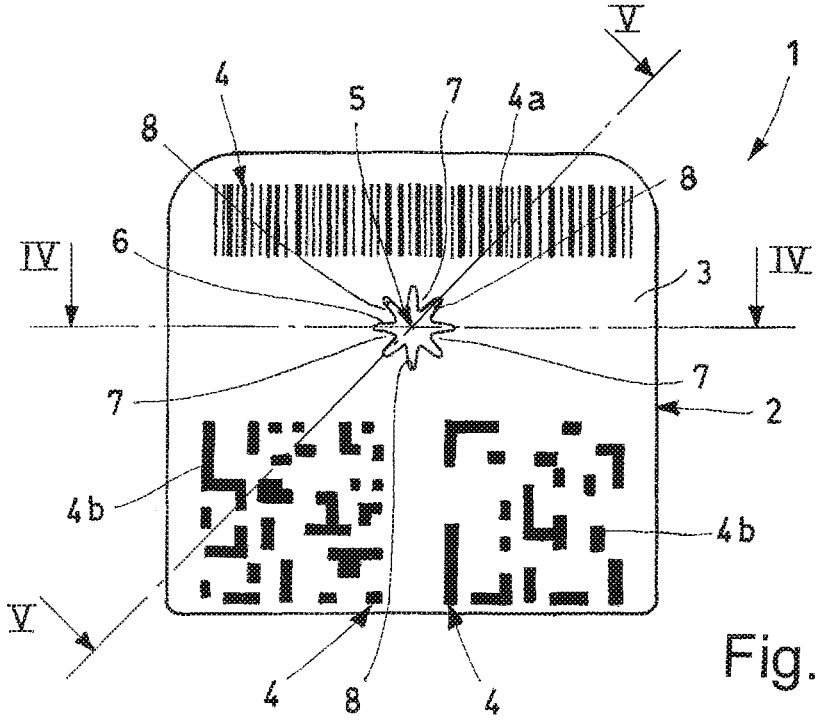
FIG. 1 is a plan view of a tag for bundles of metal products obtained from respective iron and steel processes, in accordance with a first embodiment of the present invention.
Figure 2:
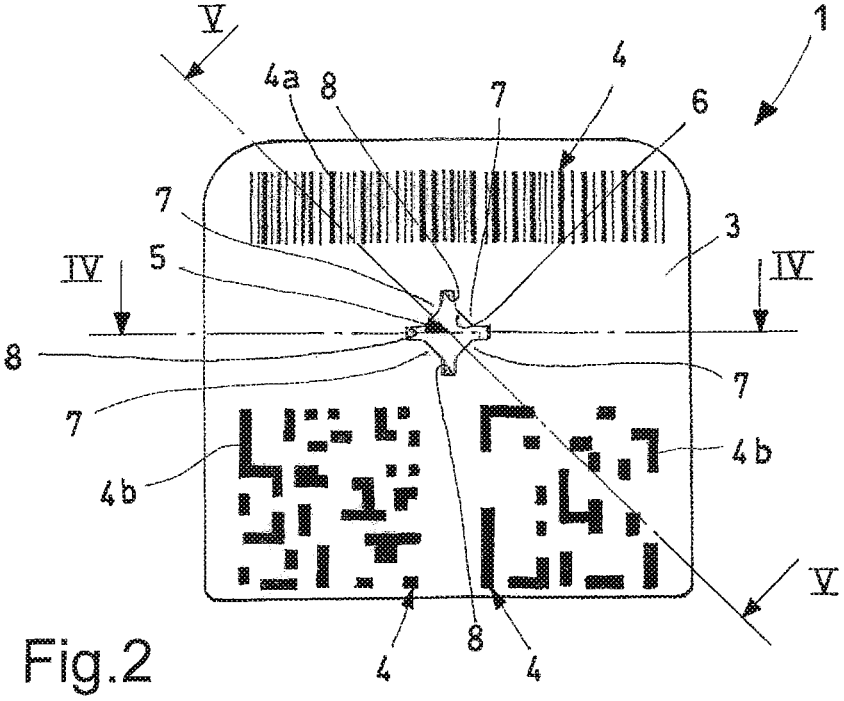
FIG. 2 is a plan view of a tag for bundles of metal products obtained from respective iron and steel processes, in accordance with a second embodiment of the present invention.

With reference to FIGS. 1 and 2, the numeral 1 designates in its entirety a tag for bundles of metal products obtained from respective iron and steel processes, in accordance with the present invention.

As shown in FIGS. 1 and 2, the tag 1 comprises at least a plate-like structure 2 made of a metal material.

The plate-like structure 2 has at least one reading surface 3 provided to support at least an identification code 4, preferably of a graphic type such as for example a barcode 4*a*, a QR code 4*b* and/or other codes, relating to at least a piece of information or one datum concerning a respective bundle of metal products (not shown because they are known) obtained by at least an iron and steel process.

Alternatively or in addition to the graphic identification code 4, it is possible to provide also an identification code (not shown in the figures) consisting of notches, slits, holes or similar structural variations of the plate-like structure 2 of the tag 1.

Also with reference to FIGS. 1 and 2, the plate-like structure 2 of the tag 1 has at least one through-opening 5 with a ragged profile.

In detail, the through-opening 5 of the plate-like structure 2 has a profile 6 provided with at least one interference protrusion 7 so that the through-opening 5 is narrower at the interference protrusion 7.

More in detail, the through-opening 5 of the plate-like structure 2 has a plurality of interference protrusions 7 that extend radially towards the centre of the through opening, defining a plurality of concavities 8 positioned between the protrusions.

Figure 3:
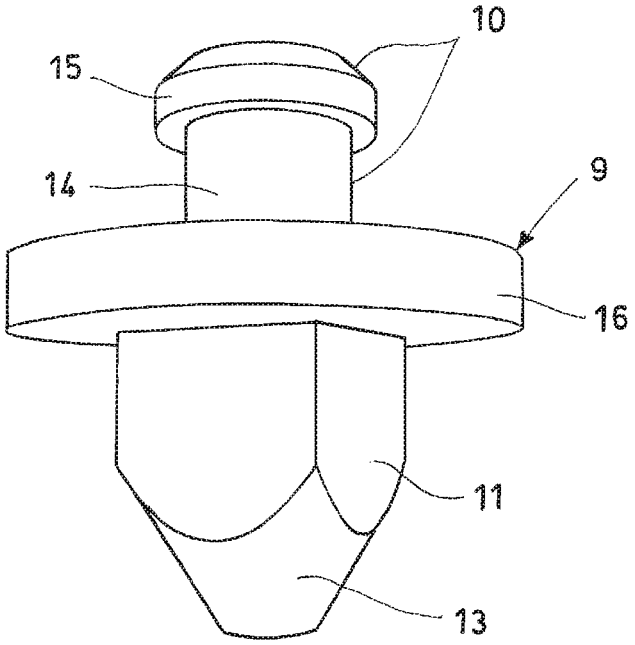
FIG. 3 is a perspective view of a junction element of the tag of FIGS. 1 and 2.
Figure 4:
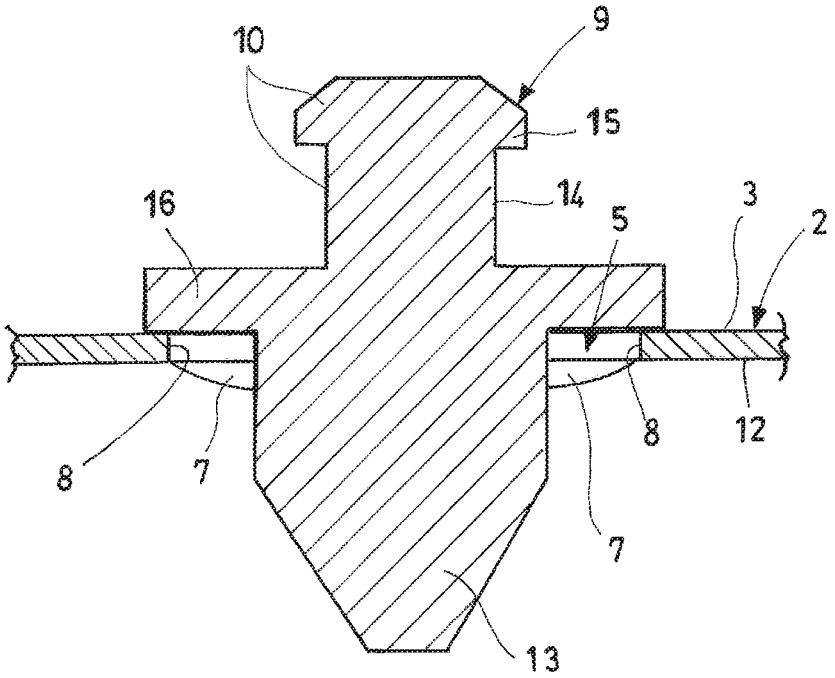
FIG. 4 is a section of the coupling of the tag of FIGS. 1 and 2 with the junction element of FIG. 3, obtained along the line IV-IV of FIGS. 1 and 2.
Figure 5:
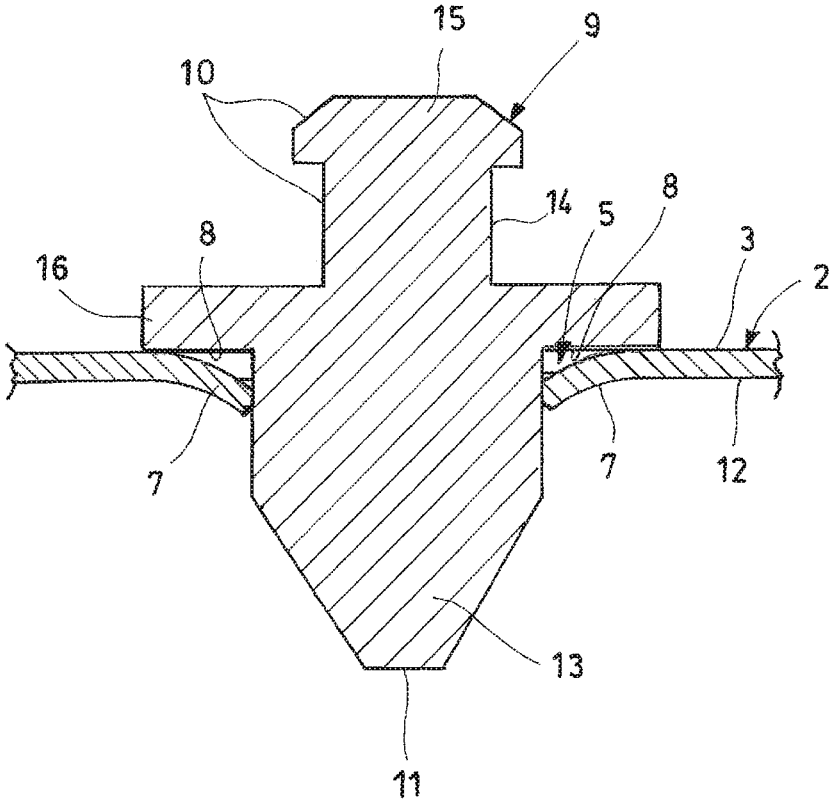
FIG. 5 is an additional section of the coupling of the tag of FIGS. 1 and 2 with the junction element of FIG. 3, obtained along the line V-V of FIGS. 1 and 2.
Figure 6:
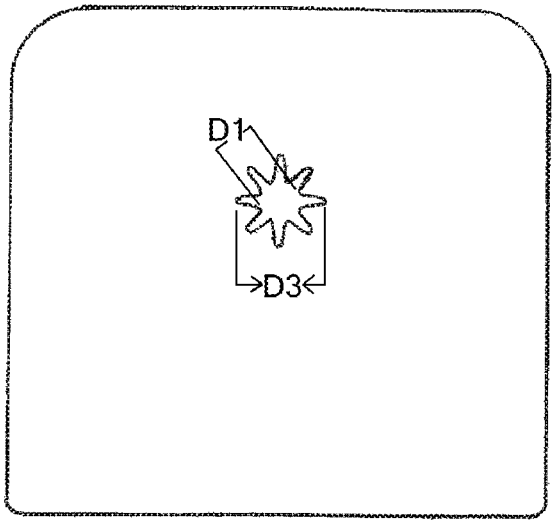
FIG. 6 is a plan view of the tag of FIG. 1, with bar codes removed for clarity, illustrating a first diameter D1 within the interference protrusions, and a distance D3, being between opposite ones of a plurality of concavities between the interference protrusions.
Figure 7:
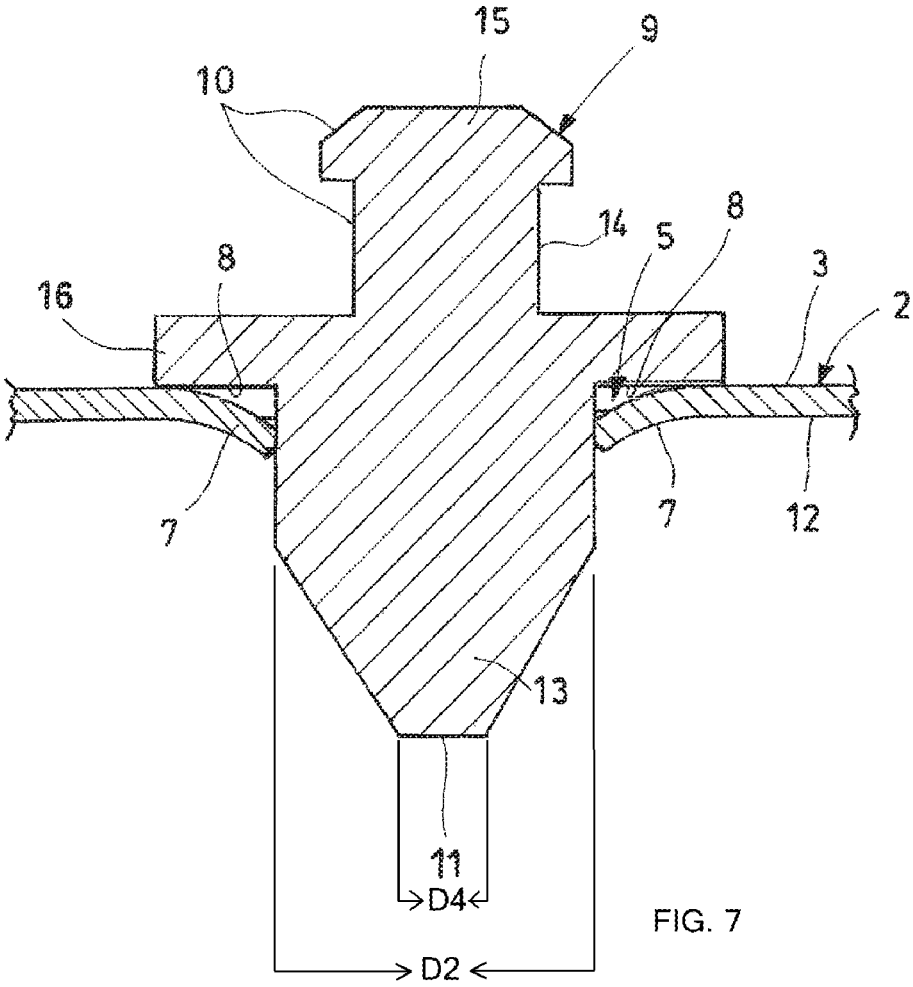
FIG. 7 is a section view of FIG. 5 with a second diameter D2 labeled, being a diameter of an engagement portion of the fixing portion, and an insertion diameter D4, being a diameter of an insertion end of the fixing portion.

As shown in FIGS. 3 through 5, the tag 1 is provided with at least a junction element 9 engageable to the plate-like structure 2 so that they are integrally translatable and rotatable.

The junction element 9 has a gripping portion 10 that protrudes from the reading surface 3 of the plate-like structure 2 and is adapted to be gripped by a gripping head (not shown) of a robot or an automated mechanical arm (not shown).

The junction element 9 also has a fixing portion 11, opposite the gripping portion 10, which protrudes from a surface 12 of the plate-like structure 2 opposite the reading surface 3.

The fixing portion 11 of the junction element 9 can be fixed to a respective bundle of metal products, preferably by means of at least a welding operation.

As shown in FIGS. 4 and 5, the junction element 9 can be inserted by interference into the through-opening 5 of the plate-like structure 2 on the side of the reading surface 3 thereof, so that the junction element 9 and the plate-like structure 2 remain joined, even during their movement.

When the junction element 9 is inserted by interference in the through-opening 5 of the plate-like structure 2 on the side of the reading surface 3 of the latter, the interference protrusions 7 bend on a side opposite the reading surface 3 of the plate-like structure 2 clamping the junction element 9 in the through-opening 5.

As shown in FIGS. 4 and 5, the junction element 5 engages the through-opening 5 by means of the fixing portion 11, which has a substantially prism-like configuration, having a profile, in cross section, which is substantially polygonal.

In detail, the fixing portion 11 of the junction element 9 has a substantially prism-like configuration, having a profile, in cross-section, which is substantially square.

To facilitate the insertion of the junction element 9 in the through-opening 5 of the plate-like structure 2 of the tag 1, the fixing portion 11 of the junction element 9 is at least partly tapered having a reduced section 13 with respect to the rest of the body.

As shown in the figures from 3 to 5, the gripping portion 10 of the junction element 9 has a substantially cylindrical configuration, having a profile, in cross-section which is substantially circular.

In detail, the gripping portion 10 of the junction element 9 has at least one circular groove 14 or a circular relief 15 for facilitating the gripping of the junction element 9 by the gripping head of the robot or of the automated mechanical arm tasked with moving the tags 1.

Also with reference to the figures from 3 to 5, the junction element 9 comprises at least one abutment portion 16 interposed between the gripping portion 10 and the fixing portion 11. When the junction element 9 is inserted in the through-opening 5 of the plate-like structure 2 of the tag 1, the abutment portion 16 abuts against the reading surface 3 of the plate-like structure 2.

Advantageously, the junction element 9 is made of a metal material so as to allow the creation of an electric arc between it and the metal product to be tracked and to allow the welding and the fixing of the respective tag 1.

Preferably, the junction element 9 is obtained from a metal material, still more preferably an iron and steel metal, for example a brass or tin based alloy.

Advantageously, the junction element 9 is obtained from a metal material having a melting point between 300° C. and 1100° C. at atmospheric pressure, preferably not greater than 900° C., whereby during a suitable heating step, carried out by means of a furnace or an appropriate burner, the junction element 9 melts allowing to remove the tag 1 from the respective bundle of metal products.

The tag described above solves the problems observed in the prior art and achieves important advantages.

First of all, the label thus conceived and configured allows a simple, easy and rapid coupling of the junction element that is inserted in the through-opening of the respective plate-like structure locking therein by interference. Once the junction element is inserted in the through-opening of the respective tag, any movement of the junction element carried out by the gripping head of the respective robot or of the respective automated mechanical arm determines the consequent integral movement of the plate-like structure of the label.

Consequently, it is no longer necessary to manipulate the plate-like structure of the tag simultaneously with other support elements because the junction element is moved integrally with the tag itself by the respective robot or by the respective automated mechanical arm.

The coupling between the junction element and the tag considerably facilitates and simplifies the welding operation that is carried out rapidly bringing the tag at the bundle of metal products to be tracked until the formation of the electric arc between it and the fixing portion of the respective junction element.

The invention claimed is:

1. A metal product's tag comprising:

at least one plate structure made of a metal material, the plate structure having at least one reading surface adapted to support at least one identification code relating to at least one piece of information or one datum pertaining to a respective bundle of metal products obtained from at least one iron and steel process, wherein the plate structure has at least one through-opening defined within a plurality of interference protrusions that extend radially towards a center of the at least one through-opening, the plurality of interference protrusions defining a plurality of concavities positioned between each of the plurality of interference protrusions, the at least one through-opening having a first diameter;

at least one junction element made of metal, engageable to the plate structure so that they can be moved and rotated integrally, the junction element having a gripping portion projecting from the reading surface of the plate structure and adapted to be gripped by a gripping head of a robot or an automated mechanical arm, the junction element also having a fixing portion, opposite the gripping portion, protruding from a surface of the plate structure opposite the reading surface, the fixing portion of the junction element being fixable to a respective bundle of metal products by means of an electric-arc welding operation, wherein the fixing portion having a second diameter at a location where the fixing portion engages with the at least one plate structure when the at least one junction element is joined with the plate structure; and the second diameter being larger than the first diameter and smaller than a distance between opposite ones of the plurality of concavities such that the fixing portion directly deforms, via frictional interference, each of the plurality of interference protrusions and each of the plurality of interference protrusions contact respective sides of the fixing portion during engagement with the at least one plate structure.

2. The tag according to claim 1, wherein the junction element is configured to be inserted by interference into the through-opening of the plate structure on the side of the reading surface of the plate structure, so that the junction element and the plate structure remain joined, even during their movement.

3. The tag according to claim 1, wherein the junction element is configured to be inserted by interference into the through-opening of the plate structure on the side of the reading surface of the plate structure, the interference protrusion being bent on a side opposite the reading surface of the plate structure clamping the junction element in the through-opening.

4. The tag according to claim 1, wherein the fixing portion of the junction element has a substantially prism configuration, having a profile, in cross-section, which is substantially polygonal.

5. The tag according to claim 1, wherein the gripping portion of the junction element has a substantially cylindrical configuration, having a profile, in cross-section, which is substantially circular.

6. The tag according to claim 5, wherein the gripping portion of the junction element has at least one circular groove or a circular relief for facilitating the gripping of the junction element by the gripping head of a robot or an automated mechanical arm.

7. The tag according to claim 1, wherein the junction element comprises at least one abutment portion interposed between the gripping portion and the fixing portion, the abutment portion abutting against the reading surface of the plate structure when the junction element is engaged to the same.

8. The tag according to claim 1, wherein the metal material of the junction element has a melting point corresponding to a temperature between 300° C. and 1100° C. at atmospheric pressure, whereby during a heating step, carried out by means of a furnace or a burner, the junction element melts allowing removal of the tag from the respective bundle of metal products.

9. The tag according to claim 1, wherein the metal material of the junction element has a melting point corresponding to a temperature between 300° C. and 900° C. at atmospheric pressure, whereby during a heating step, carried out by means of a furnace or a burner, the junction element melts, allowing removal of the tag from the respective bundle of metal products.

10. A metal product's tag comprising:

a plate structure, the plate structure having at least one reading surface adapted to support at least one identification code relating to at least one piece of information or one datum pertaining to a respective bundle of metal products obtained from at least one iron and steel process, wherein the plate structure has at least one through-opening defined within a plurality of interference protrusions that extend radially towards a center of the at least one through-opening, the plurality of interference protrusions defining a plurality of concavities positioned between each of the plurality of interference protrusions, the at least one through-opening having a first diameter;

a junction element made of metal having a gripping portion projecting from the reading surface of the plate structure when the at least one junction element is engaged with the plate structure, the junction element also having a fixing portion, opposite the gripping portion, protruding from a surface of the plate structure opposite the reading surface when the at least one junction element is engaged with the plate structure, the junction element further including an abutment portion disposed between the gripping portion and the fixing portion, the abutment portion disposed adjacent the plate structure when the at least one junction element is engaged with the plate structure, wherein the fixing portion has an insertion end with a third diameter;

the fixing portion has an engagement portion, extending between the insertion end and the abutment portion, the engagement portion having a second diameter;

the second diameter being larger than the first diameter and smaller than a distance between opposite ones of the plurality of concavities such that the fixing portion directly deforms, via frictional interference, each of the plurality of interference protrusions resulting in integral movement and rotation between the plate structure and the junction element; and each of the plurality of interference protrusions contact respective sides of the fixing portion during engagement with the at least one plate structure.

11. The metal product's tag of claim 10, wherein the second diameter is less than the first diameter.

12. A method for attaching a tag to a metal product comprising:

providing a plate structure, the plate structure having at least one reading surface adapted to support at least one identification code relating to at least one piece of information or one datum pertaining to a respective bundle of metal products obtained from at least one iron and steel process, wherein the plate structure has at least one through-opening defined within a plurality of interference protrusions that extend radially towards a center of the at least one through-opening, the plurality of interference protrusions defining a plurality of concavities positioned between each of the plurality of interference protrusions, the at least one through-opening having a first diameter;

inserting a junction element partially into the through-opening, the junction element made of metal a and having a gripping portion projecting from the reading surface of the plate structure when the at least one junction element is engaged with the plate structure, the junction element also having a fixing portion, opposite the gripping portion, protruding from a surface of the plate structure opposite the reading surface when the at least one junction element is engaged with the plate structure, the junction element further including an abutment portion disposed between the gripping portion and the fixing portion, the abutment portion disposed adjacent the plate structure when the at least one junction element is engaged with the plate structure; and welding the fixing portion to the metal product, wherein the fixing portion has an insertion end with a third diameter;

the fixing portion has an engagement portion, extending between the insertion end and the abutment portion, the engagement portion having a second diameter;

the second diameter being larger than the first diameter such that the fixing portion directly deforms, via frictional interference, each of the plurality off interference protrusions resulting in integral movement and rotation between the plate structure and the junction element; and each of the plurality of interference protrusions contact respective sides of the fixing portion during engagement with the at least one plate structure.

* * * * *